US009873575B2

(12) United States Patent
Aizono

(10) Patent No.: US 9,873,575 B2
(45) Date of Patent: Jan. 23, 2018

(54) IMAGE FORMING APPARATUS THAT DISPLAYS REMAINING AMOUNT OF SHEETS, CONTROL METHOD THEREFOR, AND STORAGE MEDIUM

(71) Applicant: CANON KABUSHIKI KAISHA, Tokyo (JP)

(72) Inventor: Keisuke Aizono, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/086,682

(22) Filed: Mar. 31, 2016

(65) Prior Publication Data

US 2016/0289014 A1 Oct. 6, 2016

(30) Foreign Application Priority Data

Apr. 6, 2015 (JP) ..... 2015-077973

(51) Int. Cl.

| | |
|---|---|
| ***B65H 1/28*** | (2006.01) |
| ***B65H 1/26*** | (2006.01) |
| ***B65H 5/00*** | (2006.01) |
| ***B65H 7/04*** | (2006.01) |
| ***B65H 7/20*** | (2006.01) |
| ***G03G 15/00*** | (2006.01) |

(52) U.S. Cl.

CPC ..... *B65H 1/28* (2013.01); *B65H 1/266* (2013.01); *B65H 5/006* (2013.01); *B65H 7/04* (2013.01);

(Continued)

(58) Field of Classification Search

CPC ... B65H 1/28; B65H 1/30; B65H 7/04; B65H 7/14; B65H 2405/3311; B65H 2511/20;

(Continued)

(56) References Cited

U.S. PATENT DOCUMENTS 6,123,329 A * 9/2000 Sato ..... B65H 1/14 271/145
6,603,952 B2 * 8/2003 Hoene ..... B65H 1/14 271/157

(Continued)

FOREIGN PATENT DOCUMENTS

| | | | |
|---|---|---|---|
| CN | 1689946 | A | 11/2005 |
| CN | 103129127 | A | 6/2013 |
| CN | 103787100 | A | 5/2014 |
| CN | 104683625 | A | 6/2015 |
| JP | 2001257833 | A | 9/2001 |
| JP | 2005053633 | A * | 3/2005 |
| JP | 2009263014 | A | 11/2009 |

OTHER PUBLICATIONS

Office Action issued in Chinese Appln. No. 201610210371.1 dated Aug. 2, 2017. English translation provided.

*Primary Examiner* — Luis A Gonzalez

(74) *Attorney, Agent, or Firm* — Rossi, Kimms & McDowell LLP

(57) ABSTRACT

An image forming apparatus which prevents degradation of sheets stacked in a stacking unit. A sheet feeding unit has a first stacking unit and a second stacking unit. When sheets stacked in the first stacking unit have run out, sheets stacked in the second stacking unit are moved to the first stacking unit. A remaining amount of sheets in the sheet feeding unit is indicated on a display unit. When sheets are stacked in the second stacking unit, the display unit provides an indication that a remaining amount of sheets in the sheet feeding unit is the largest.

11 Claims, 11 Drawing Sheets

(52) U.S. Cl.
CPC ..... *B65H 7/20* (2013.01); *G03G 15/6508* (2013.01); *B65H 2301/42264* (2013.01); *B65H 2405/15* (2013.01); *B65H 2511/152* (2013.01); *B65H 2511/30* (2013.01); *B65H 2513/40* (2013.01); *B65H 2551/18* (2013.01); *B65H 2551/26* (2013.01); *B65H 2551/27* (2013.01); *B65H 2801/06* (2013.01); *G03G 15/6511* (2013.01); *G03G 2215/00729* (2013.01)

(58) Field of Classification Search
CPC .. B65H 2511/21; B65H 2511/26; B65H 1/18; B65H 1/266
See application file for complete search history.

(56) References Cited

U.S. PATENT DOCUMENTS

| | | | | |
|---|---|---|---|---|
| 8,177,222 | B2 * | 5/2012 | Yaginuma | B65H 1/14 271/152 |
| 2009/0072467 | A1 * | 3/2009 | Ohno | B65H 1/28 271/9.01 |
| 2012/0074640 | A1 * | 3/2012 | Chae | B65H 1/266 271/9.03 |
| 2013/0142559 | A1 * | 6/2013 | Iguchi | B41J 13/0009 400/583 |
| 2015/0130124 | A1 * | 5/2015 | Muto | B65H 7/04 271/9.03 |

* cited by examiner

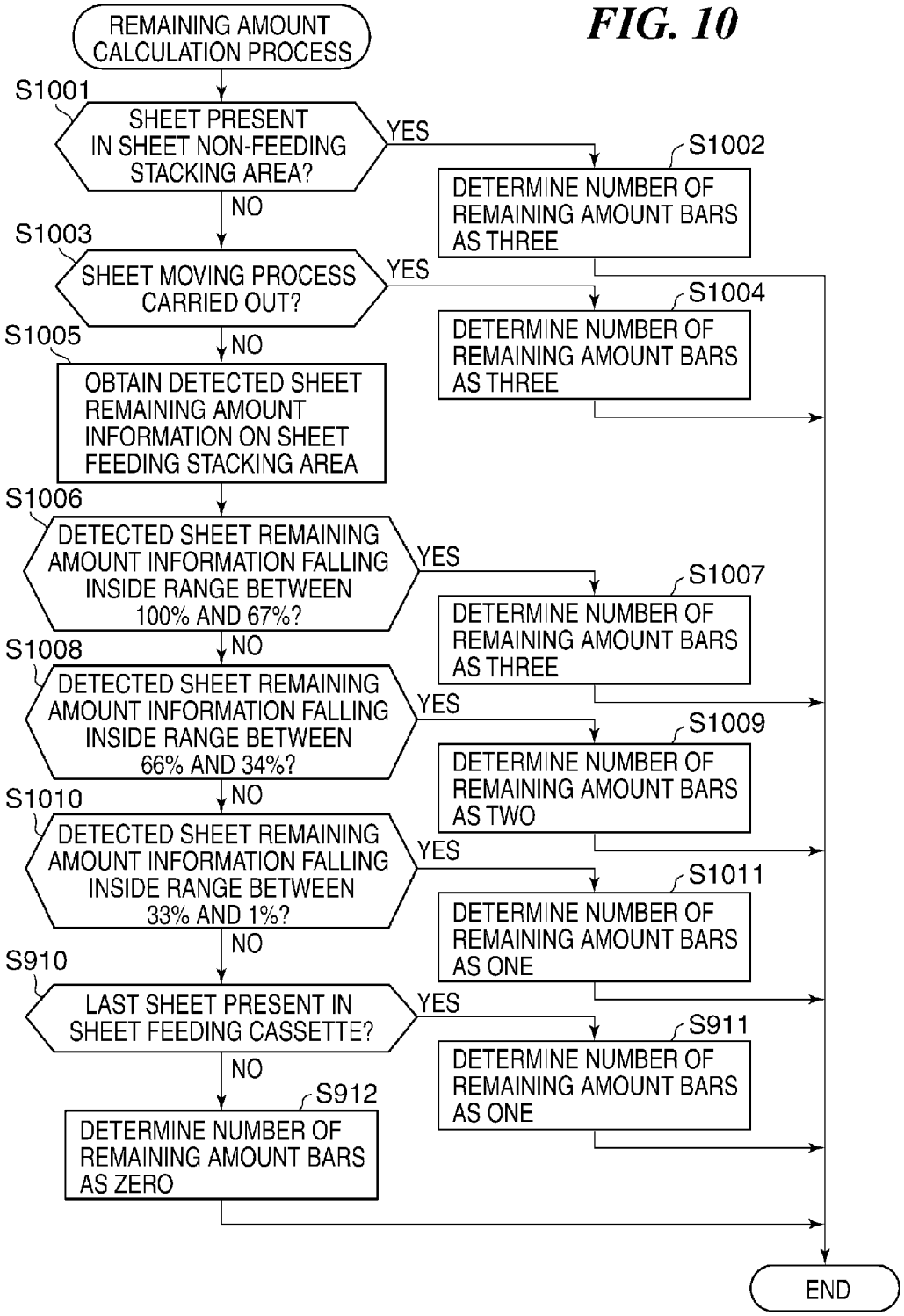
FIG. 10
REMAINING AMOUNT CALCULATION PROCESS
S1001
SHEET PRESENT IN SHEET NON-FEEDING STACKING AREA?
YES
NO
S1002
DETERMINE NUMBER OF REMAINING AMOUNT BARS AS THREE
S1003
SHEET MOVING PROCESS CARRIED OUT?
YES
NO
S1004
DETERMINE NUMBER OF REMAINING AMOUNT BARS AS THREE
S1005
OBTAIN DETECTED SHEET REMAINING AMOUNT INFORMATION ON SHEET FEEDING STACKING AREA
S1006
DETECTED SHEET REMAINING AMOUNT INFORMATION FALLING INSIDE RANGE BETWEEN 100% AND 67%?
YES
NO
S1007
DETERMINE NUMBER OF REMAINING AMOUNT BARS AS THREE
S1008
DETECTED SHEET REMAINING AMOUNT INFORMATION FALLING INSIDE RANGE BETWEEN 66% AND 34%?
YES
NO
S1009
DETERMINE NUMBER OF REMAINING AMOUNT BARS AS TWO
S1010
DETECTED SHEET REMAINING AMOUNT INFORMATION FALLING INSIDE RANGE BETWEEN 33% AND 1%?
YES
NO
S1011
DETERMINE NUMBER OF REMAINING AMOUNT BARS AS ONE
S910
LAST SHEET PRESENT IN SHEET FEEDING CASSETTE?
YES
NO
S911
DETERMINE NUMBER OF REMAINING AMOUNT BARS AS ONE
S912
DETERMINE NUMBER OF REMAINING AMOUNT BARS AS ZERO
END

IMAGE FORMING APPARATUS THAT DISPLAYS REMAINING AMOUNT OF SHEETS, CONTROL METHOD THEREFOR, AND STORAGE MEDIUM

BACKGROUND OF THE INVENTION

Field of the Invention

The present invention relates to an image forming apparatus, a control method therefor, and a storage medium, and in particular to an image forming apparatus that displays a remaining amount of sheets, a control method therefor, and a storage medium.

Description of the Related Art

An MFP which is an image forming apparatus carries out a printing process using sheets, which are fed from a plurality of sheet feeding cassettes and an external sheet feeding deck which are sheet feeding units, as recording sheets. The sheet feeding deck is capable of storing a larger amount of sheets than the sheet feeding cassettes are, and thus, for example, used to make a large amount of copies at once.

There is also known a sheet feeding apparatus which has a plurality of, for example, two stacking units, in which sheets are stacked when they are stored, as sheet feeding units capable of storing a much larger amount of sheets (hereafter referred to as "the large-capacity sheet feeding apparatus"). In the large-capacity sheet feeding apparatus, one stacking unit (hereafter referred to as "the sheet feeding stacking unit") has a sheet feeding port for feeding sheets, and sheets stacked in the sheet feeding stacking unit are fed from the sheet feeding port. When sheets stacked in the sheet feeding stacking unit have run out, the large-capacity sheet feeding apparatus moves sheets stacked in the other stacking unit (hereafter referred to as "the sheet non-feeding stacking unit") having no sheet feeding port for feeding sheets (see, for example, Japanese Laid-Open Patent Publication (Kokai) No. 2009-263014).

In a conventional sheet feeding apparatus, a remaining amount of sheets is displayed on a display unit or the like provided in an MFP so that a user can see a remaining amount of sheets stored in the sheet feeding apparatus. A remaining amount of sheets is calculated based on a remaining amount of sheets stacked in a stacking unit and displayed on the display unit of the MFP. On the display unit, a remaining amount of sheets is displayed using a plurality of, for example, three remaining amount bars, and the number of remaining amount bars is determined based on a remaining amount of sheets in the sheet feeding apparatus. Based on the number of remaining amount bars displayed on the display unit, the user determines whether or not to replenish sheets.

However, in the large-capacity sheet feeding apparatus having the sheet feeding stacking unit and the sheet non-feeding stacking unit described above, when the sheet feeding stacking unit and the sheet non-feeding stacking unit are replenished with sheets based on a remaining amount of sheets in the large-capacity sheet feeding apparatus which is displayed on the display unit, the sheets may not be properly replenished. Here, when a certain amount of sheets have been fed from the sheet feeding stacking unit, a remaining amount of sheets in the large-capacity sheet feeding apparatus is calculated based on a remaining amount of sheets in the sheet feeding stacking unit and remaining amount of sheets in the sheet non-feeding stacking unit, and based on the calculated remaining amount of sheets in the large-capacity sheet feeding apparatus, the number of remaining amount bars displayed on the display unit decreases. In this case, it can be considered that a user replenishes the sheet feeding stacking unit and the sheet non-feeding stacking unit with sheets so as to prevent sheets in the sheet feeding stacking unit and the sheet non-feeding stacking unit from running out. However, for example, when the user replenishes the sheet feeding stacking unit with sheets in a state where sheets are stacked in the sheet non-feeding stacking unit, the sheets stacked in the sheet non-feeding stacking unit retain in the sheet non-feeding stacking unit without being moved to the sheet feeding stacking unit. Here, when the user repeatedly replenishes the sheet feeding stacking unit with sheets, the sheets continue to retain in the sheet non-feeding stacking unit. As the sheets continue to retain, they degrade due to humidity and passage of time, and hence the user needs to determine the appropriate timing for replenishing sheets with consideration given to retention of sheets in the sheet non-feeding stacking unit.

SUMMARY OF THE INVENTION

The present invention provides an image forming apparatus and a control method therefor which are capable of preventing degradation of sheets stacked in a stacking unit, as well as a storage medium.

Accordingly, the present invention provides an image forming apparatus with a sheet feeding unit that has a first stacking unit and a second stacking unit, comprising a moving unit configured to, when sheets stacked in the first stacking unit have run out, move sheets stacked in the second stacking unit to the first stacking unit, and a display unit configured to provide an indication of a remaining amount of sheets in the sheet feeding unit, wherein in response to sheets being stacked in the second stacking unit, the display unit provides an indication that a remaining amount of sheets in the sheet feeding unit is the largest.

According to the present invention, degradation of sheets stacked in the stacking unit is prevented.

Further features of the present invention will become apparent from the following description of exemplary embodiments (with reference to the attached drawings).

BRIEF DESCRIPTION OF THE DRAWINGS

FIGS. 3A and 3B are views useful in explaining an arrangement of a large-capacity sheet feeding cassette in FIG. 2, in which FIG. 3A shows an arrangement of the large-capacity sheet feeding cassette, and FIG. 3 shows how sheets stored in the large-capacity sheet feeding cassette are moved.

FIG. 10 is a flowchart showing the procedure of a remaining amount calculating process which is carried out by the image forming apparatus in FIG. 1.

DESCRIPTION OF THE EMBODIMENTS

Hereafter, an embodiment of the present invention will be described in detail with reference to the drawings.

In the present embodiment described hereafter, the present invention is applied to an image forming apparatus, but the present invention should not always be applied to an image forming apparatus but may be applied to information processing apparatuses such as a client PC and a mobile terminal as long as they are capable of displaying remaining amounts of sheets stored in respective sheet feeding cassettes, to be described later, provided in an image forming apparatus based on a variety of information transmitted from the image forming apparatus.

Figure 1:
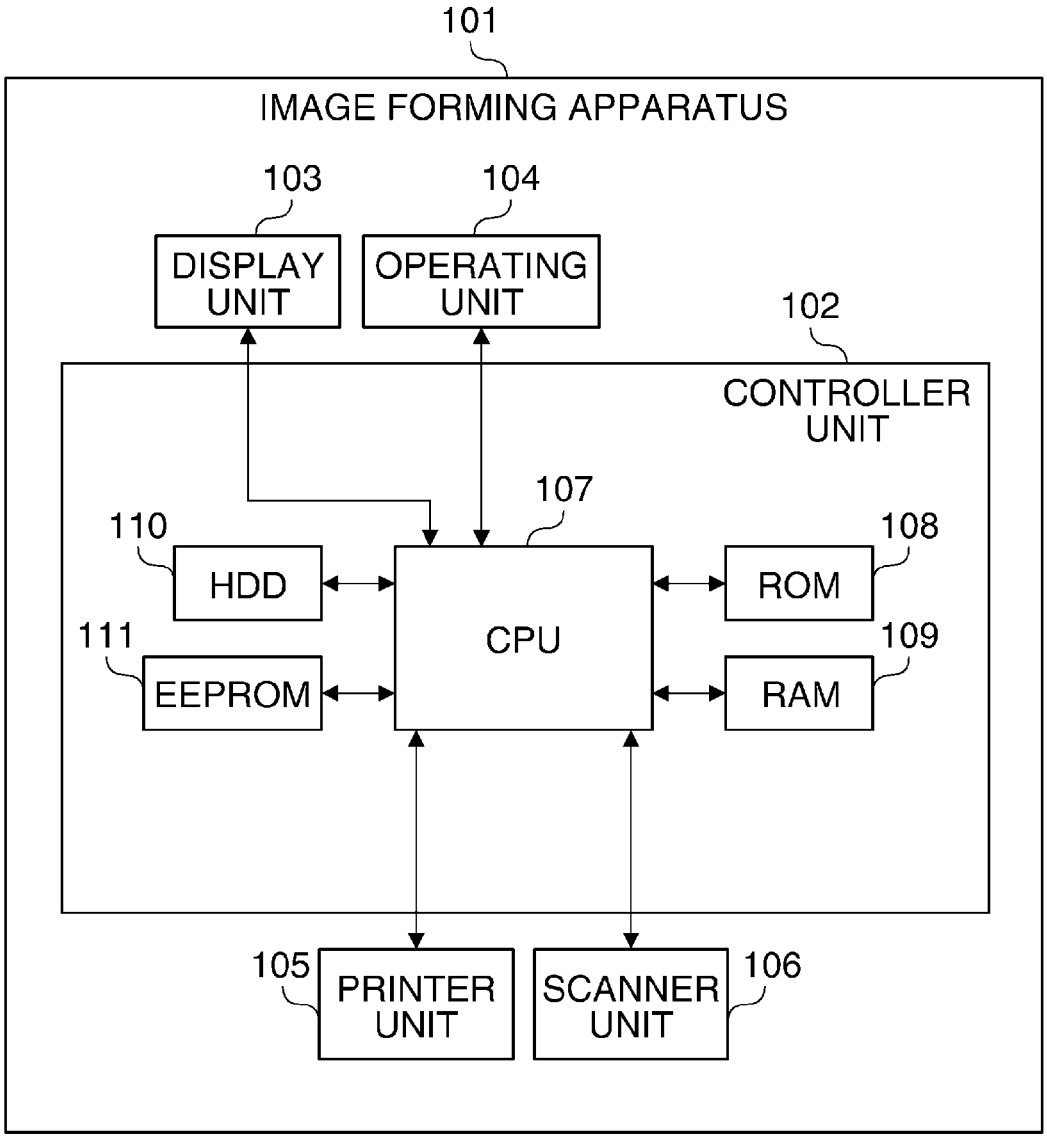
FIG. 1 is a block diagram schematically showing an arrangement of an image forming apparatus according to an embodiment of the present invention.

FIG. 1 is a block diagram schematically showing an arrangement of an image forming apparatus 101 according to an embodiment of the present invention.

Referring to FIG. 1, the image forming apparatus 101 has a controller unit 102, a display unit 103, an operating unit 104, a printer unit 105, and a scanner unit 106. The controller unit 102 has a CPU 107, a ROM 108, a RAM 109, an HDD 110, and an EEPROM 111. The CPU 107 is connected to each of the component elements, that is, the display unit 103, the operating unit 104, the printer unit 105, the scanner unit 106, the ROM 108, the RAM 109, the HDD 110, and the EEPROM 111.

The display unit 103 has an LED, a liquid crystal display, and so forth, not shown, and displays a variety of operating screens. In the present embodiment, the display unit 103 displays information indicative of, for example, remaining amounts of sheets in respective ones of sheet feeding cassettes 204 and 205 and a large-capacity sheet feeding cassette 206 in FIG. 5, to be described later. The operating unit 104 has a touch display and a variety of setting buttons, and sends a variety of setting information set through operation of the operating unit 104 by a user to the CPU 107 of the controller unit 102. The printer unit 105 performs printing on a sheet based on a print job for carrying out a printing process sent from the CPU 107. The scanner unit 106 reads image information on an original placed on an original platen glass, not shown, based on a scan job for carrying out a scanning process sent from the CPU 107 and generates image data based on the read image information. The generated image data is stored in, for example, the HDD 110.

The controller unit 102 centrally controls the overall image forming apparatus 101. The CPU 107 controls the component elements, to which the CPU 107 is connected to control them. The ROM 108 stores, for example, a boot program required to start a system for the image forming apparatus 101. The RAM 109, which is a volatile memory, is used as a work area for the CPU 107 to execute a variety of control programs stored in the ROM 108 and the HDD 110. The HDD 110 is a storage medium such as a magnetic disk and stores a variety of control programs and a variety of image data. The EEPROM 111 is a nonvolatile memory and stores setting values for use in executing a variety of control programs.

Figure 2:
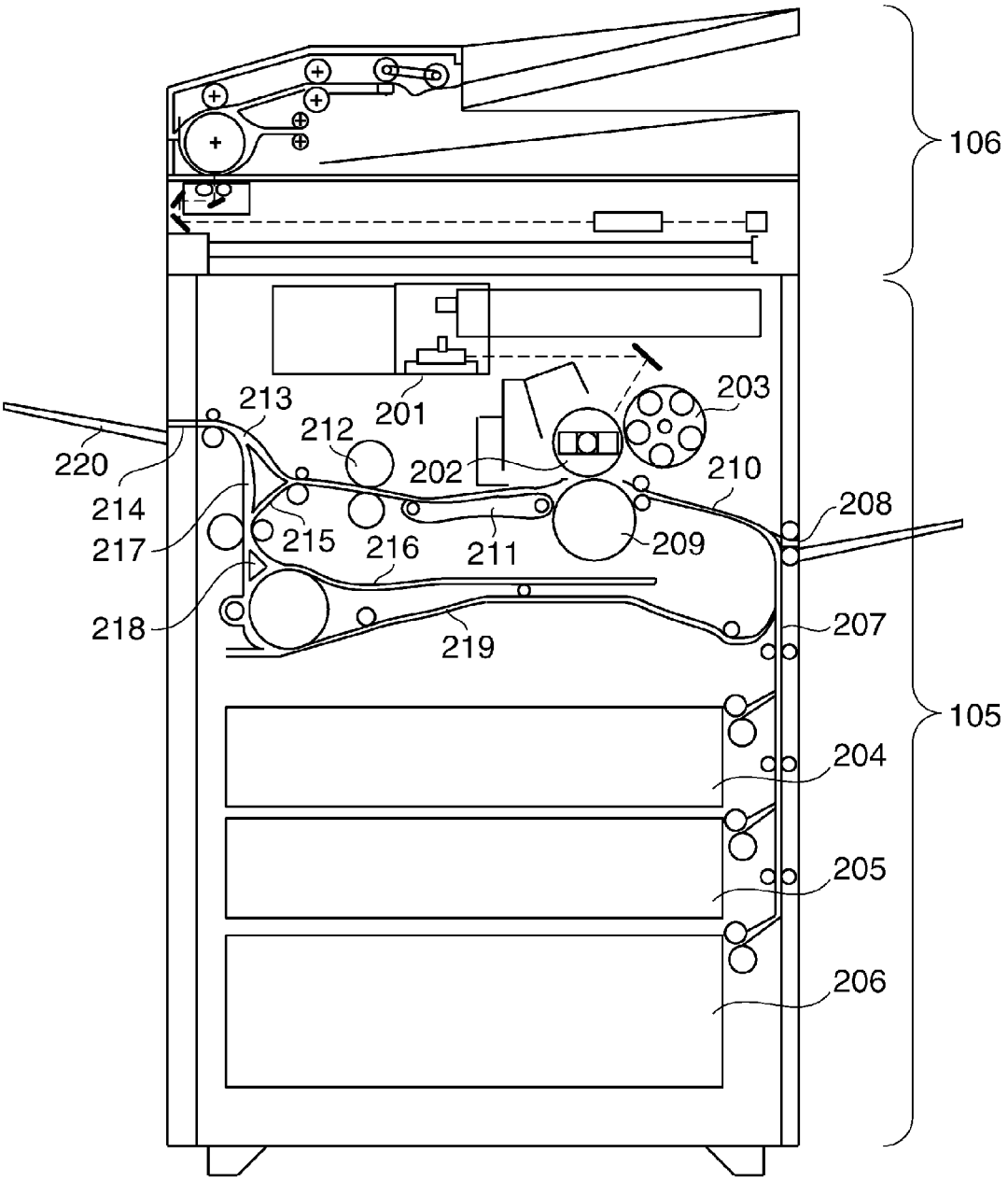
FIG. 2 is a side view showing a printer unit in FIG. 1 and for use in explaining the procedure of a process from conveyance of a sheet to discharge of the sheet by the printer unit.

FIG. 2 is a side view showing the printer unit 105 in FIG. 1 and for use in explaining the procedure of a process from conveyance of a sheet to discharge of the sheet by the printer unit 105. It should be noted that in FIG. 2, the printer unit 105 is illustrated with its internal component elements seen through so as to be easily understood.

Referring to FIG. 2, the printer unit 105 has a laser driver 201, a photosensitive drum 202, a developer unit 203, the sheet feeding cassettes 204 and 205, the large-capacity sheet feeding cassette 206, a manual sheet feeding deck 208, a transfer unit 209, conveying paths 210 and 213 to 217, a conveying belt 211, a fixing unit 212, a flapper 218, a sheet re-feeding conveying path 219, and a discharged-sheet tray 220.

The sheet feeding cassettes 204 and 205 and the large-capacity sheet feeding cassette 206 are each configured to be drawn out and store sheets for use in printing. The large-capacity sheet feeding cassette 206 is capable of storing a larger amount of sheets than each of the sheet feeding cassettes 204 and 205 is. The sheet feeding cassettes 204 and 205 and the large-capacity sheet feeding cassette 206 are each equipped with a variety of sensors, which detect a remaining amount of sheets in each sheet feeding cassette, such as a remaining amount detection sensor 306, to be described later. The laser driver 201 emits laser light based on image data sent from the controller unit 102 and radiates the laser light onto the photosensitive drum 202. According to the radiated laser light, a latent image is formed on the photosensitive drum 202. The developer unit 203 attaches a developer to the latent image formed on the photosensitive drum 202.

On the other hand, in synchronization of starting of laser light radiation under the control of the laser driver 201, a sheet is fed from the sheet feeding cassette 204 or 205, the large-capacity sheet feeding cassette 206, or the manual sheet feeding deck 208 on which sheets are placed. The fed sheet is conveyed to the transfer unit 209 through the conveying path 210, and the transfer unit 209 transfers the developer attached to the photosensitive drum 202 onto the fed sheet. The sheet onto which the developer has been transferred is then conveyed to the fixing unit 212 by the conveying belt 211, and the developer transferred onto the sheet is fixed on the sheet through heat and pressure applied by the fixing unit 212.

After that, when the sheet is to be discharged without being inverted, the sheet on which the developer has been fixed is discharged onto the discharged-sheet tray 220 through the conveying paths 213 and 214. When the sheet is to be discharged after being inverted, the sheet on which the developer has been fixed is conveyed to the conveying path 216 through the conveying path 215, not the conveying path 213, and inverted. This sheet is conveyed to the conveying path 216, then conveyed in a direction opposite to the direction in which the sheet has been conveyed up to the conveying path 216, and discharged onto the discharged-sheet tray 220 through the conveying paths 217 and 214.

Figure 3A:
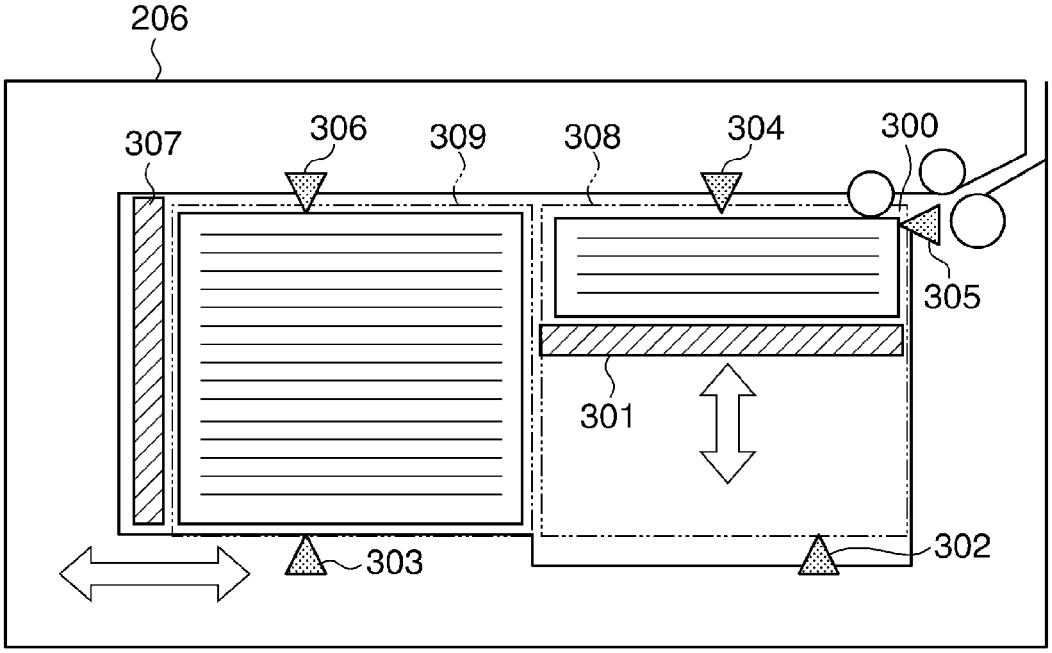
Figure 3B:
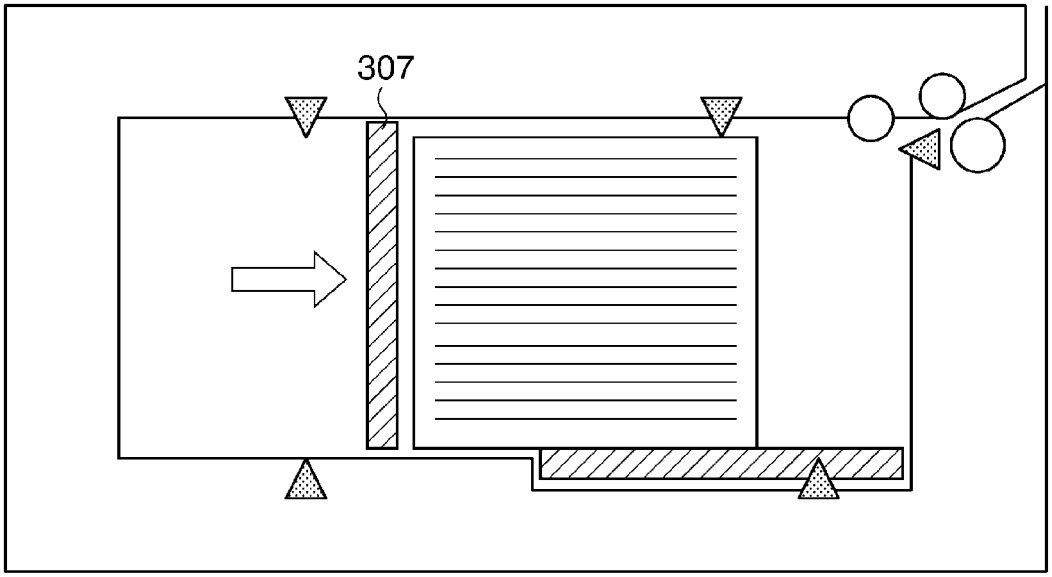

FIGS. 3A and 3B are views useful in explaining an arrangement of the large-capacity sheet feeding cassette 206 in FIG. 2, in which FIG. 3A shows an arrangement of the large-capacity sheet feeding cassette 206, and FIG. 3B shows how sheets stored in the large-capacity sheet feeding cassette 206 are moved.

The large-capacity sheet feeding cassette 206 has a sheet feeding port 300, a lifter plate 301, sheet detection sensors 302 and 303, a height detection sensor 304, a last sheet detection sensor 305, a remaining amount detection sensor 306, and a pushing plate 307 (moving unit). The large-capacity sheet feeding cassette 206 has a plurality of, for example, two sheet stacking areas (hereafter referred to as "the sheet feeding stacking area 308" and "the sheet non-feeding stacking area 309") in which sheets are allowed to be stacked. The sheet feeding stacking area 308 (first stacking unit) and the sheet non-feeding stacking area 309 (second stacking unit) are equipped with respective trays (hereafter referred to as "the right tray" and "the left tray"), and sheets of the same size are allowed to be stacked on the trays. It should be noted that amounts of sheets that allowed to be stored in the sheet feeding stacking area 308 and the sheet non-feeding stacking area 309 are determined based on a size of the large-capacity sheet feeding cassette 206, but in the following description, it is assumed that in the present embodiment, for example, the same amount of sheets are allowed to be stacked in the sheet feeding stacking area 308 and the sheet non-feeding stacking area 309.

The lifter plate 301 is configured to be able to move up and down, and the right tray is provided on the lifter plate 301. When the lifter plate 301 moves up, an uppermost one of sheets stacked in the sheet feeding stacking area 308 is fed from the sheet feeding port 300 (or discharged from the large-capacity sheet feeding cassette 206). The sheet detection sensors 302 and 303 detect the presence or absence of sheets stacked in the sheet feeding stacking area 308 and the sheet non-feeding stacking area 309, respectively, and sends results of the detection to the CPU 107. The height detection sensor 304 detects a remaining amount of sheets stacked in the sheet feeding stacking area 308. In the present embodiment, for example, the height detection sensor 304 calculates a remaining amount of sheets stacked in the sheet feeding stacking area 308 based on a distance to the lifter plate 301, and when the lifter plate 301 comes into contact with the height detection sensor 304, detects that the sheets stacked in the sheet feeding stacking area 308 have run out.

The last sheet detection sensor 305 detects feeding of a last sheet stacked in the sheet feeding stacking area 308. The remaining amount detection sensor 306 optically measures a stacking height of sheets stacked in the sheet non-feeding stacking area 309 to detect a remaining amount of sheets. The pushing plate 307 is configured to be able to be pushed out, and when sheets stacked in the sheet feeding stacking area 308 have run out, the pushing plate 307 pushes out and moves sheets stacked in the sheet non-feeding stacking area 309 to the sheet feeding stacking area 308 as shown in FIG. 3B. After pushing out the sheets to the sheet feeding stacking area 308, the pushing plate 307 moves back to its original position.

Figure 4:
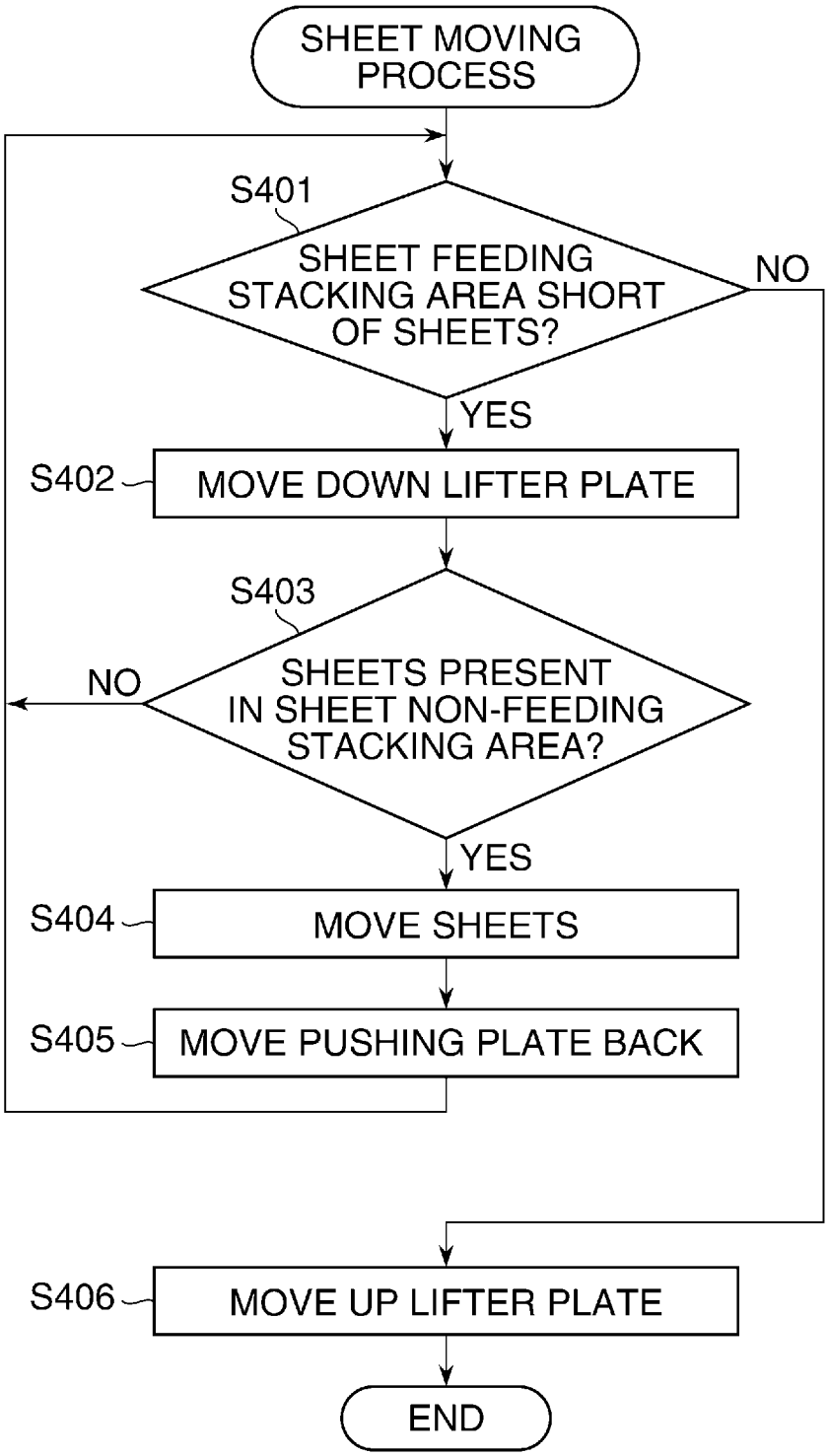
FIG. 4 is a flowchart useful in explaining the procedure of a sheet moving process which is carried out by the large-capacity sheet feeding cassette in FIG. 3A.

FIG. 4 is a flowchart showing the procedure of a sheet moving process which is carried out by the large-capacity sheet feeding cassette 206 in FIGS. 3A and 3B.

The process in FIG. 4 is carried out by the CPU 107 executing a variety of programs stored in the ROM 108 and the HDD 110. It should be noted that the process in FIG. 4 is carried out on the precondition that a sheet feeding process in which sheets are fed from the sheet feeding port 300 is being carried out.

Referring to FIG. 4, first, the CPU 107 determines whether or not the sheet feeding stacking area 308 is short of sheets based on detection results obtained by the sheet detection sensor 302, the height detection sensor 304, and the last sheet detection sensor 305 (step S401). In the present embodiment, when the sheet detection sensor 302 and the height detection sensor 304 detect that sheets stacked in the sheet feeding stacking area 308 have run out, and the last sheet detection sensor 305 detects feeding of a last sheet stacked in the sheet feeding stacking area 308, the CPU 107 determines that the sheet feeding stacking area 308 is short of sheets. On the other hand, when the sheet detection sensor 302 and the height detection sensor 304 detect the presence of sheets stacked in the sheet feeding stacking area 308, or the last sheet detection sensor 305 has not detected feeding of a last sheet stacked in the sheet feeding stacking area 308, the CPU 107 determines that the sheet feeding stacking area 308 is not short of sheets.

As a result of the determination in the step S401, when the sheet feeding stacking area 308 is short of sheets, the CPU 107 moves down the lifter plate 301 to its original position, for example, a lowermost position (step S402). The CPU 107 then determines whether or not sheets are present in the sheet non-feeding stacking area 309 based on a detection result obtained by the sheet detection sensor 303 (step S403).

When the CPU 107 determines in the step S403 that no sheets are present in the sheet non-feeding stacking area 309, the process returns to the step S401. As a result of the determination in the step S403, when sheets are present in the sheet non-feeding stacking area 309, the CPU 107 controls the pushing plate 307 to move the sheets stacked in the sheet non-feeding stacking area 309 to the sheet feeding stacking area 308 (step S404). The CPU 107 then moves the pushing plate 307 to its original position (step S405), followed by the process returning to the step S401. It should be noted that in the present embodiment, the user is not allowed to replenish sheets while the process from the step S402 to the step S405 is in progress.

As a result of the determination in the step S401, when the sheet feeding stacking area 308 is not short of sheets, the CPU 107 moves up the lifter plate 301 (step S406) and feeds an uppermost one of sheets stacked in the sheet feeding stacking area 308 from the sheet feeding port 300 and ends the present process.

Figure 5:
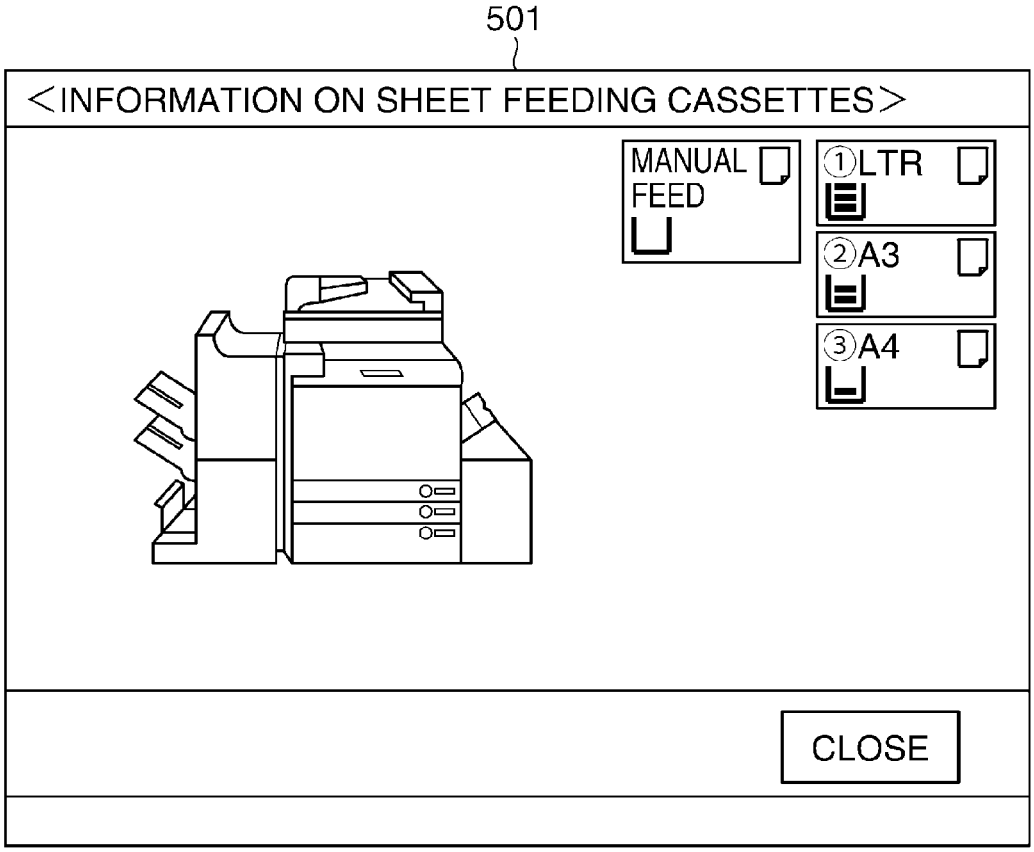
FIG. 5 is a view useful in explaining remaining amounts of sheets in respective sheet feeding cassettes, which are displayed on a display unit in FIG. 1.

A description will now be given of a sheet remaining amount display process in which remaining amounts of sheets in respective ones of the sheet feeding cassettes 204 and 205 and the large-capacity sheet feeding cassette 206 are displayed on the display unit 103. In the present embodiment, in response to an instruction from the user, remaining amounts of sheets in respective ones of the sheet feeding cassettes 204 and 205 and the large-capacity sheet feeding cassette 206 are displayed on the display unit 103, and the remaining amounts of sheets are indicated by remaining amount bars as shown on an operating screen 501 in FIG. 5. In FIG. 5, when the number of remaining amount bars is three, it indicates that the remaining amount of sheets is the largest, that is, each sheet feeding cassette is full; when zero, it indicates that the remaining amount of sheets is zero; and when one or two, it indicates that the remaining amount of sheets is a stepwise amount between the largest amount and zero.

Figure 6:
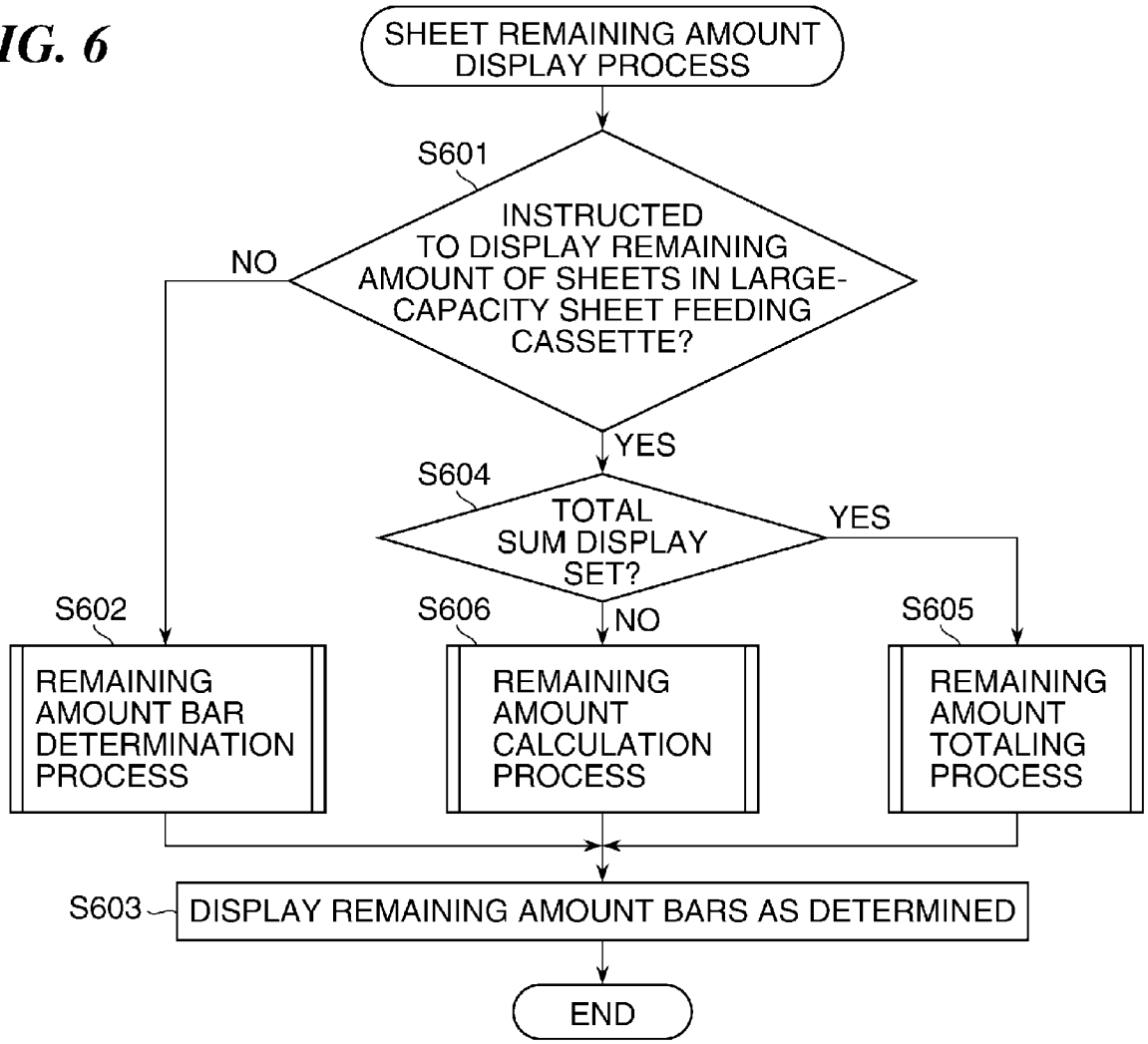
FIG. 6 is a flowchart showing the procedure of a sheet remaining amount display process which is carried out by the image forming apparatus in FIG. 1.

FIG. 6 is a flowchart showing the procedure of the sheet remaining amount display process which is carried out by the image forming apparatus 101 in FIG. 1.

The process in FIG. 6 is carried out by the CPU 107 executing a variety of programs stored in the ROM 108 and the HDD 110. It should be noted that the process in FIG. 6 is carried out on the precondition that there has been an instruction to display a remaining amount of sheets in any of the sheet feeding cassettes 204 and 205 and the large-capacity sheet feeding cassette 206.

Referring to FIG. 6, first, the CPU 107 determines whether or not a display instruction issued by the user is an instruction to display a remaining amount of sheets in the large-capacity sheet feeding cassette 206 among the sheet feeding cassettes 204 and 205 and the large-capacity sheet feeding cassette 206 (step S601).

As a result of the determination in the step S601, when the display instruction issued by the user is not an instruction to display a remaining amount of sheets in the large-capacity sheet feeding cassette 206 but an instruction to display a remaining amount of sheets in either of the sheet feeding cassettes 204 and 205, for example, the sheet feeding cassette 204, the CPU 107 carries out a remaining bar determination process in FIG. 8, to be described later, to determine the number of remaining amount bars corresponding to the remaining amount of sheets in the sheet feeding cassettes 204 (step S602). The CPU 107 then displays the determined number of remaining amount bars on the display unit 103 (step S603) and terminates the present process.

Figure 7:
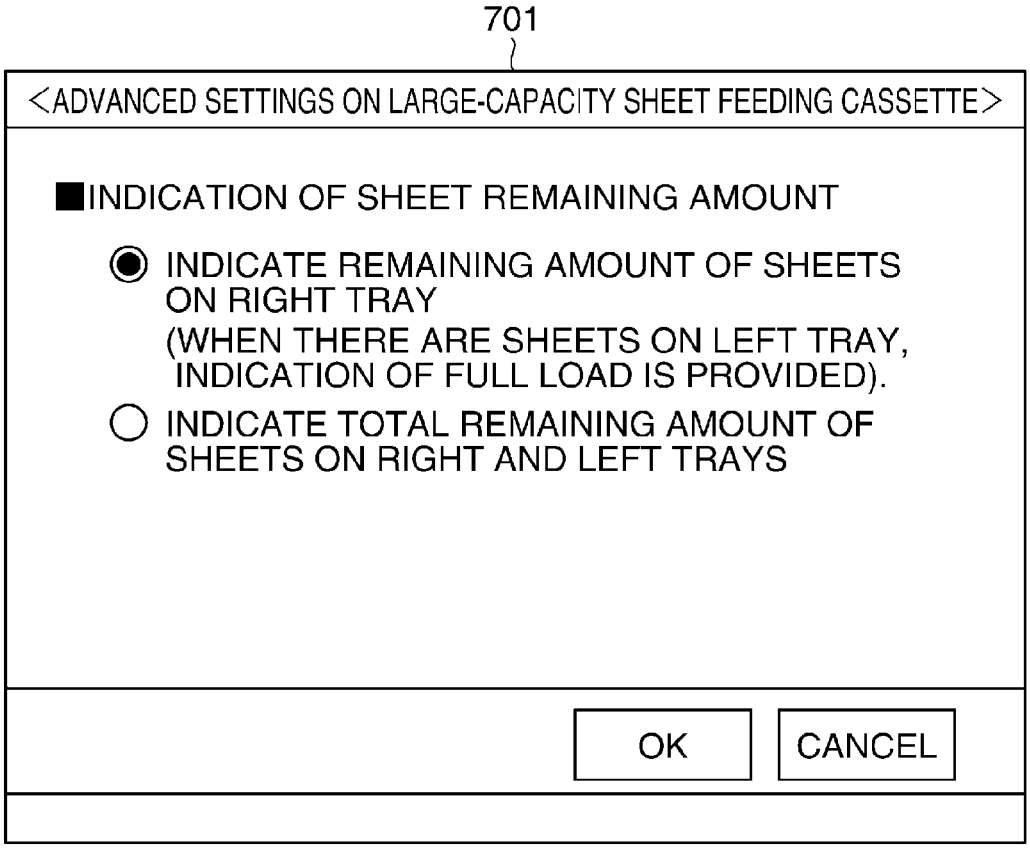
FIG. 7 is a view useful in explaining settings on total sum display for use in the sheet remaining amount display process in FIG. 6.

As a result of the determination in the step S601, when the display instruction issued by the user is an instruction to display a remaining amount of sheets in the large-capacity sheet feeding cassette 206, the CPU 107 determines whether or not total sum display (mode) in which remaining amounts of sheets in the sheet feeding stacking area 308 and the sheet non-feeding stacking area 309 are totaled is selected for display of a remaining amount of sheets in the large-capacity sheet feeding cassette 206 (step S604). In the present embodiment, total sum display is selected in advance by the user using an operating screen 701 in FIG. 7 displayed on the display unit 103. In the step 604, when "display a total remaining amount of sheets on the right tray and the left tray"" in FIG. 7 is selected, the CPU 107 determines that total sum display is selected. On the other hand, when "display a remaining amount of sheets on the right tray" in FIG. 7 is selected, the CPU 107 determines that total sum display is not selected.

As a result of the determination in the step S604, when total sum display is selected, the CPU 107 carries out a remaining amount totaling process in FIG. 9, to be described later, to calculate a remaining amount of sheets in the large-capacity sheet feeding cassette 206 by totaling remaining amounts of sheets in the sheet feeding stacking area 308 and the sheet non-feeding stacking area 309. After that, the CPU 107 determines the number of remaining amount bars corresponding to the calculated remaining amount of sheets (step S605), carries out the process in the step S603, and terminates the present process.

As a result of the determination in the step S604, when total sum display is not selected, the CPU 107 carries out a remaining amount calculating process in FIG. 10, to be described later, to calculate a remaining amount of sheets in the large-capacity sheet feeding cassette 206 based on a remaining amount of sheets in the sheet feeding stacking area 308 and the presence or absence of sheets in the sheet non-feeding stacking area 309. After that, the CPU 107 determines the number of remaining amount bars corresponding to the calculated remaining amount of sheets (step S606), carries out the process in the step S603, and terminates the present process.

Figure 8:
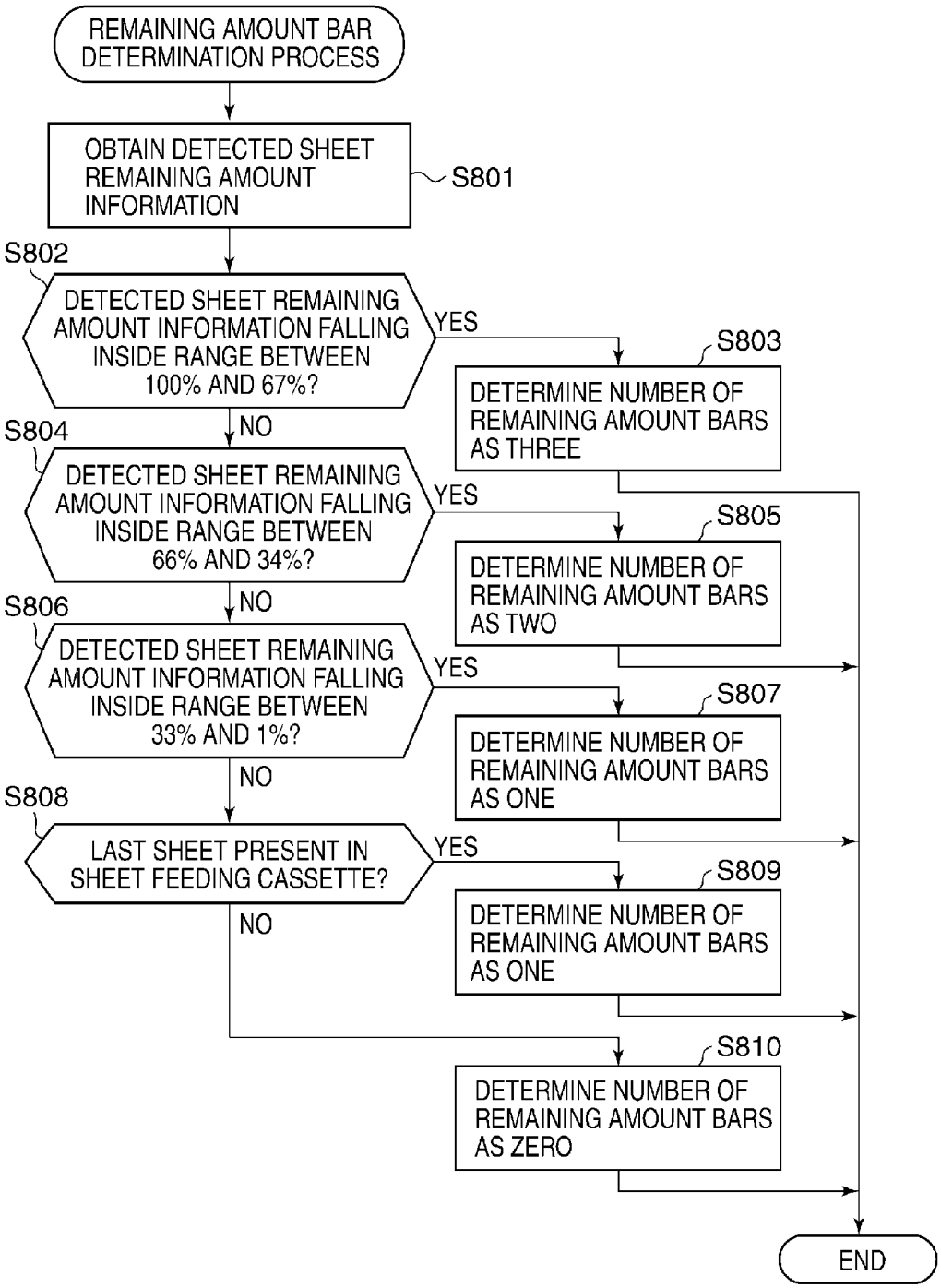
FIG. 8 is a flowchart showing the procedure of a remaining amount bar determination process which is carried out by the image forming apparatus in FIG. 1.

FIG. 8 is a flowchart showing the procedure of the remaining amount bar determination process which is carried out by the image forming apparatus 101 in FIG. 1.

The process in FIG. 8 is carried out by the CPU 107 executing a variety of programs stored in the ROM 108 and the HDD 110.

Referring to FIG. 8, first, the CPU 107 obtains information indicative of a remaining amount of sheets in one of the sheet feeding cassettes 204 and 205, that is, a remaining amount of sheets in the sheet feeding cassette 204 for which a display instruction has been issued by the user (hereafter referred to as "detected sheet remaining amount information") from a sensor, not shown, provided in the sheet feeding cassette 204 (step S801). In the present embodiment, the detected sheet remaining amount information is expressed as a percentage relative to a maximum amount of sheets allowed to be stacked in the sheet feeding cassette 204. When the detected sheet remaining amount information is 100%, this indicates that a remaining amount of sheets in the sheet feeding cassette 204 is the largest, that is, the sheet feeding cassette 204 is full, and when the detected sheet remaining amount information is 0%, this indicates that no sheets are present in the sheet feeding cassette 204.

Then, the CPU 107 determines whether or not the detected sheet remaining amount information falls inside a range between 100% and 67% (step S802). As a result of the determination in the step S802, when the detected sheet remaining amount information falls inside the range between 100% and 67%, the CPU 107 determines the number of remaining amount bars corresponding to the remaining amount of sheets in the sheet feeding cassette 204 as "three" (step S803) and terminates the present process. As a result of the determination in the step S802, when the detected sheet remaining amount information does not fall inside the range between 100% and 67%, the CPU 107 determines whether or not the detected sheet remaining amount information falls inside a range between 66% and 34% (step S804).

As a result of the determination in the step S804, when the detected sheet remaining amount information falls inside the range between 66% and 34%, the CPU 107 determines the number of remaining amount bars corresponding to the remaining amount of sheets in the sheet feeding cassette 204 as "two" (step S805) and terminates the present process. As a result of the determination in the step S804, when the detected sheet remaining amount information does not fall inside the range between 66% and 34%, the CPU 107 determines whether or not the detected sheet remaining amount information falls inside a range between 33% and 1% (step S806).

As a result of the determination in the step S806, when the detected sheet remaining amount information falls inside the range between 33% and 1%, the CPU 107 determines the number of remaining amount bars corresponding to the remaining amount of sheets in the sheet feeding cassette 204 as "one" (step S807) and terminates the present process. As a result of the determination in the step S806, when the detected sheet remaining amount information does not fall inside the range between 33% and 1%, the CPU 107 determines whether or not a last sheet is present in the sheet feeding cassette 204 (step S808).

As a result of the determination in the step S808, when a last sheet is present in the sheet feeding cassette 204, the CPU 107 determines the number of remaining amount bars corresponding to the remaining amount of sheets in the sheet feeding cassette 204 as "one" (step S809) and terminates the present process. As a result of the determination in the step S808, when no last sheet is present in the sheet feeding cassette 204, the CPU 107 determines the number of remaining amount bars corresponding to the remaining amount of sheets in the sheet feeding cassette 204 as "zero" (step S810) and terminates the present process.

Figure 9:
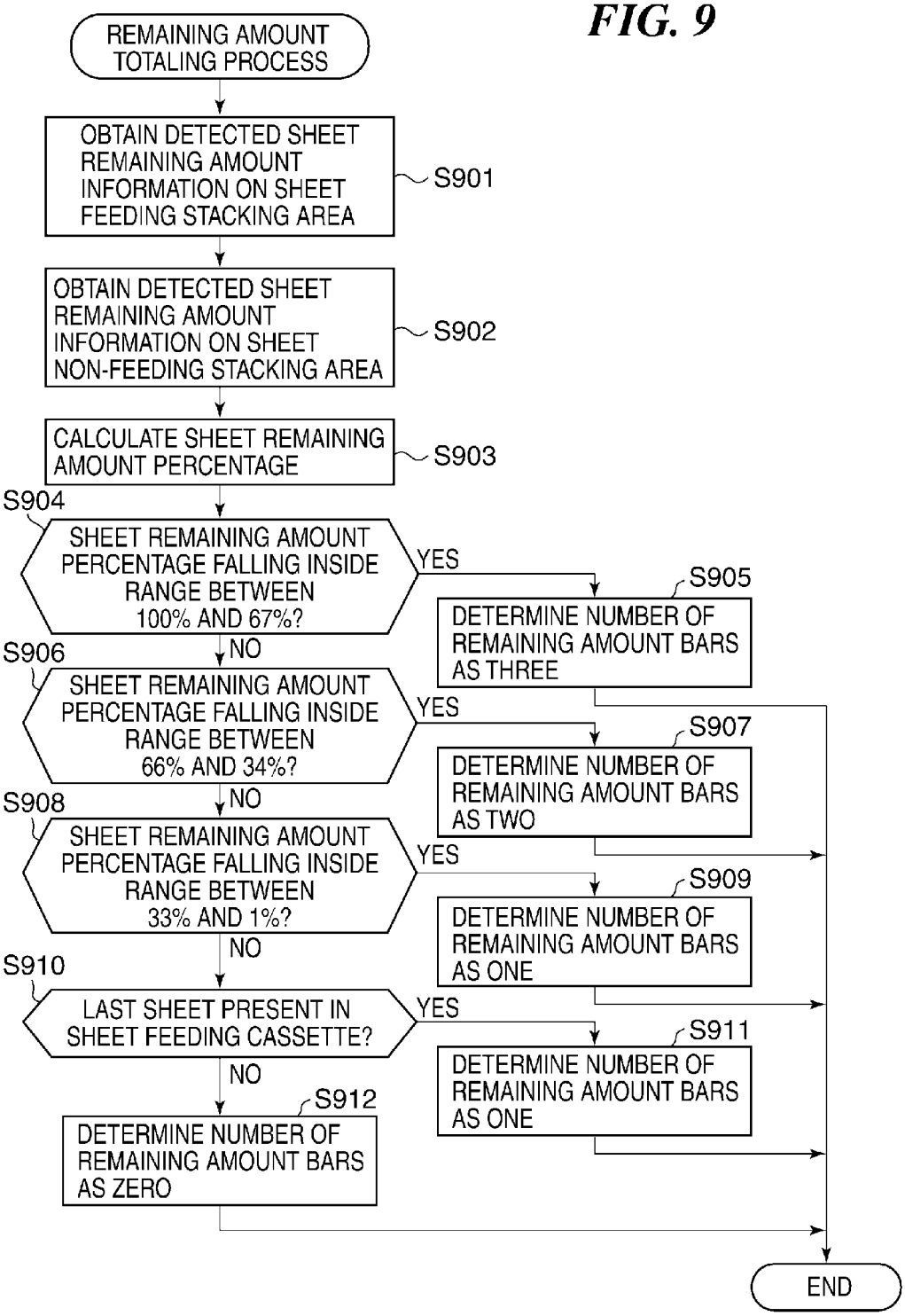
FIG. 9 is a flowchart showing the procedure of a remaining amount totaling process which is carried out by the image forming apparatus in FIG. 1.

FIG. 9 is a flowchart showing the procedure of the remaining amount totaling process which is carried out by the image forming apparatus 101 in FIG. 1.

The process in FIG. 9 is carried out by the CPU 107 executing a variety of programs stored in the ROM 108 and the HDD 110.

Referring to FIG. 9, first, the CPU 107 obtains detected sheet remaining amount information on the sheet feeding stacking area 308 from the height detection sensor 304 (step S901) and obtains detected sheet remaining amount information on the sheet non-feeding stacking area 309 from the remaining amount detection sensor 306 (step S902). In the step S902, when, for example, sheets have been moved from the sheet non-feeding stacking area 309 to the sheet feeding stacking area 308, detected sheet remaining amount information on the sheet feeding stacking area 308 and the sheet non-feeding stacking area 309 before the sheets are moved from the sheet feeding stacking area 308 is used. Then, based on the detected sheet remaining amount information on the sheet feeding stacking area 308 and the sheet non-feeding stacking area 309, the CPU 107 calculates a percentage of an amount of sheets remaining in the sheet feeding stacking area 308 and the sheet non-feeding stacking area 309 relative to a maximum amount of sheets allowed to be stored in the sheet feeding stacking area 308 and the sheet non-feeding stacking area 309, that is, the large-capacity sheet feeding cassette 206 (hereafter referred to as "the sheet remaining amount percentage") (step S903).

In the present embodiment, for example, an arithmetic average of detected sheet remaining amount information on the sheet feeding stacking area 308 and detected sheet remaining amount information on the sheet non-feeding stacking area 309 is obtained to calculate the sheet remaining amount percentage of the large-capacity sheet feeding cassette 206. In the present embodiment, when amounts of sheets allowed to be stacked in the sheet feeding stacking area 308 and the sheet non-feeding stacking area 309 are different, the sheet remaining amount percentage of the large-capacity sheet feeding cassette 206 is calculated based on the amounts of sheets allowed to be stacked in the respective stacking areas.

The CPU 107 then determines whether or not the sheet remaining amount percentage calculated in the step S903 falls inside a range between 100% and 67% (step S904). As a result of the determination in the step S904, when the sheet remaining amount percentage falls inside the range between 100% and 67%, the CPU 107 determines the number of remaining amount bars corresponding to the remaining amount of sheets in the large-capacity sheet feeding cassette 206 as "three" (step S905) and terminates the present process. As a result of the determination in the step S904, when the sheet remaining amount percentage does not fall inside the range between 100% and 67%, the CPU 107 determines whether or not the sheet remaining amount percentage falls inside a range between 66% and 34% (step S906).

As a result of the determination in the step S906, when the sheet remaining amount percentage falls inside the range between 66% and 34%, the CPU 107 determines the number of remaining amount bars corresponding to the remaining amount of sheets in the large-capacity sheet feeding cassette 206 as "two" (step S907) and terminates the present process. As a result of the determination in the step S906, when the sheet remaining amount percentage does not fall inside the range between 66% and 34%, the CPU 107 determines whether or not the sheet remaining amount percentage falls inside a range between 33% and 1% (step S908).

As a result of the determination in the step S908, when the sheet remaining amount percentage falls inside the range between 33% and 1%, the CPU 107 determines the number of remaining amount bars corresponding to the remaining amount of sheets in the large-capacity sheet feeding cassette 206 as "one" (step S909) and terminates the present process. As a result of the determination in the step S908, when the sheet remaining amount percentage does not fall inside the range between 33% and 1%, the CPU 107 determines whether or not a last sheet is present in the sheet feeding stacking area 308 (step S910). In the present embodiment, for example, when feeding of a last sheet has not been detected by the last sheet detection sensor 305, it is determined that a last sheet is present in the sheet feeding stacking area 308, and when feeding of a last sheet has been detected by the last sheet detection sensor 305, it is determined that no last sheet is present in the sheet feeding stacking area 308.

As a result of the determination in the step S910, when a last sheet is present in the sheet feeding stacking area 308, the CPU 107 determines the number of remaining amount bars corresponding to the remaining amount of sheets in the large-capacity sheet feeding cassette 206 as "one" (step S911) and terminates the present process. As a result of the determination in the step S910, when no last sheet is present in the sheet feeding stacking area 308, the CPU 107 determines the number of remaining amount bars corresponding to the remaining amount of sheets in the large-capacity sheet feeding cassette 206 as "zero" (step S912) and terminates the present process.

FIG. 10 is a flowchart showing the procedure of the remaining amount calculating process which is carried out by the image forming apparatus 101 in FIG. 1.

The process in FIG. 10 is carried out by the CPU 107 executing a variety of programs stored in the ROM 108 and the HDD 110.

When the user replenishes the sheet feeding stacking area 308 and the sheet non-feeding stacking area 309 with sheets based on remaining amount bars determined in the process in FIG. 9, the sheets may not be properly replenished. For example, when the number of remaining amount bars determined in the process in FIG. 9 and displayed on the display unit 103 decreases, the user may replenish the sheet feeding stacking area 308 with sheets before sheets stacked in the sheet feeding stacking area 308 run out. In this case, sheets stacked in the sheet non-feeding stacking area 309 retain in the sheet non-feeding stacking area 309 without being moved to the sheet feeding stacking area 308, and hence when the user repeatedly replenishes the sheet feeding stacking area 308 with sheets, the sheets continue to retain in the sheet non-feeding stacking area 309.

Accordingly, in the process in FIG. 10, when sheets are present in the sheet non-feeding stacking area 309, the number of remaining amount bars corresponding to the remaining amount of sheets in the sheet feeding stacking area 308 is determined as "three" irrespective of an amount of sheets remaining in the sheet feeding stacking area 308.

Referring to FIG. 10, first, the CPU 107 determines whether or not sheets are present in the sheet non-feeding stacking area 309 based on a detection result obtained by the sheet detection sensor 303 (step S1001) (determination unit). As a result of the determination in the step S1001, when sheets are present in the sheet non-feeding stacking area 309, the CPU 107 determines the number of remaining amount bars corresponding to the remaining amount of sheets in the large-opacity sheet feeding cassette 206 as "three" (step S1002) and terminates the present process. Namely, the CPU 107 determines the number of remaining amount bars as "three" irrespective of an amount of sheets remaining in the sheet feeding stacking area 308.

As a result of the determination in the step S1001, when no sheets are present in the sheet non-feeding stacking area 309, the CPU 107 determines whether or not the sheet moving process in FIG. 4 has been carried out (step S1003). In the step S1003, when an operation of the pushing plate 307, for example, a pushing-out operation of the pushing plate 307 performed so as to move sheets from the sheet non-feeding stacking area 309 to the sheet feeding stacking area 308, or movement of the pushing plate 307 back to its original position after pushing out sheets stacked in the sheet non-feeding stacking area 309 is detected, it is determined that the sheet moving process has been carried out. On the other hand, when an operation of the pushing plate 307 is not detected, it is determined that the sheet moving process has not been carried out.

As a result of the determination in the step S1003, when the sheet moving process has been carried out, the CPU 107 determines the number of remaining amount bars corresponding to the remaining amount of sheets in the large-capacity sheet feeding cassette 206 as "three" (step S1004). Specifically, in the present embodiment, when replenishment of sheets is not preferred (when sheets are present in the sheet non-feeding stacking area 309), or when replenishment of sheets is impossible (when sheets are to be moved to the sheet feeding stacking area 308), the number of remaining amount bars corresponding to the remaining amount of sheets in the large-capacity sheet feeding cassette 206 is determined as "three" so as to prevent the user from replenishing the large-capacity sheet feeding cassette 206 with sheets. After that, the CPU 107 terminates the present process.

As a result of the determination in the step S1003, when the sheet moving process has not been carried out, the CPU 107 obtains detected sheet remaining amount information on the sheet feeding stacking area 308 from the height detection sensor 304 (step S1005). The CPU 107 then determines whether or not the obtained detected sheet remaining amount information falls inside a range between 100% and 67% (step S1006).

As a result of the determination in the step S1006, when the detected sheet remaining amount information falls inside the range between 100% and 67%, the CPU 107 determines the number of remaining amount bars corresponding to the remaining amount of sheets in the large-capacity sheet feeding cassette 206 as "three" (step S1007). Specifically, in the present embodiment, when sheets in the sheet non-feeding stacking area 309 have run out, the number of remaining amount bars corresponding to the remaining amount of sheets in the large-capacity sheet feeding cassette 206 is determined based on detected sheet remaining amount information on the sheet feeding stacking area 308. After that, the CPU 107 terminates the present process. As a result of the determination in the step S1006, when the detected sheet remaining amount information does not fall inside the range between 100% and 67%, the CPU 107 determines whether or not the detected sheet remaining amount information falls inside a range between 66% and 34% (step S1008).

As a result of the determination in the step S1008, when the detected sheet remaining amount information falls inside the range between 66% and 34%, the CPU 107 determines the number of remaining amount bars corresponding to the remaining amount of sheets in the large-capacity sheet feeding cassette 206 as "two" (step S1009). Specifically, in the present embodiment, when sheets in the sheet non-feeding stacking area 309 have run out, and the remaining amount of sheets in the sheet feeding stacking area 308 has become not more than 66%, the number of remaining amount bars corresponding to the remaining amount of sheets in the large-capacity sheet feeding cassette 206 is indicated as "two" so as to provide notification that the remaining amount of sheets in the large-capacity sheet feeding cassette 206 is not enough. After that, the CPU 107 terminates the present process.

As a result of the determination in the step S1008, when the detected sheet remaining amount information does not fall inside the range between 66% and 34%, the CPU 107 determines whether or not the detected sheet remaining amount information falls inside a range between 33% and 1% (step S1010). As a result of the determination in the step S1010, when the detected sheet remaining amount information falls inside the range between 33% and 1%, the CPU 107 determines the number of remaining amount bars corresponding to the remaining amount of sheets in the large-capacity sheet feeding cassette 206 as "one" (step S1011) and terminates the present process. As a result of the determination in the step S1010, when the detected sheet remaining amount information does not fall inside the range between 33% and 1%, the CPU 107 carries out the same process as that in the steps S910 to S912 in FIG. 9 and terminates the present process.

According to the processes in FIGS. 6 and 10 described above, when sheets are stacked in the sheet non-feeding stacking area 309, an indication for preventing the user from replenishing sheets is provided. Here, when the user replenishes the sheet feeding stacking area 308 with sheets before sheets stacked in the sheet feeding stacking area 308 run out, sheets stacked in the sheet non-feeding stacking area 309 cannot be moved to the sheet feeding stacking area 308 by the sheet moving process in FIG. 4, causing the sheets stacked in the sheet non-feeding stacking area 309 to retain. It is thus preferred that sheets are replenished by the user when no sheets are stacked in the sheet non-feeding stacking area 309. Therefore, according to the processes in FIGS. 6 and 10 described above, when sheets are stacked in the sheet non-feeding stacking area 309, the number of remaining amount bars corresponding to the remaining amount of sheets in the large-capacity sheet feeding cassette 206 is indicated as "three" which is a maximum amount of sheets remaining in the large-capacity sheet feeding cassette 206 irrespective of the amount of sheets remaining in the sheet feeding stacking area 308. On the other hand, when no sheets are stacked in the sheet non-feeding stacking area 309, remaining amount bars corresponding to the remaining amount of sheets in the large-capacity sheet feeding cassette 206 are displayed based on detected sheet remaining amount information on the sheet feeding stacking area 308. As a result, the appropriate timing with which the user replenishes sheets is identified. Namely, sheets stacked in the sheet non-feeding stacking area 309 are prevented from retaining, and this prevents degradation of sheets stacked in the sheet non-feeding stacking area 309 due to retention of the sheets.

Moreover, according to the processes in FIGS. 6 and 10 described above, an indication for preventing the user from replenishing sheets is provided while sheets stacked in the sheet non-feeding stacking area 309 are being moved to the sheet feeding stacking area 308. Here, the user is not allowed to replenish sheets during a time period over which sheets stacked in the sheet non-feeding stacking area 309 are being moved to the sheet feeding stacking area 308. However, during this time period, remaining amount bars corresponding to a remaining amount of sheets in the large-capacity sheet feeding cassette 206 are displayed as "three" bars, and this prevents the user from replenishing the sheet feeding stacking area 308 and the sheet non-feeding stacking area 309 with sheets. As a result, the sheet moving process in which sheets stacked in the sheet non-feeding stacking area 309 are moved to the sheet feeding stacking area 308 is prevented from being obstructed.

It should be noted that in the embodiment described above, even when no sheets are present in the sheet non-feeding stacking area 309, the number of remaining amount bars corresponding to a remaining amount of sheets in the large-capacity sheet feeding cassette 206 is "three" until detected sheet remaining amount information on the sheet feeding stacking area 308 becomes not more than 66%, but when no sheets are present in the sheet non-feeding stacking area 309, the number of remaining amount bars corresponding to a remaining amount of sheets in the large-capacity sheet feeding cassette 206 may be determined as "two" or less based on detected sheet remaining amount information on the sheet feeding stacking area 308.

Figure 11:
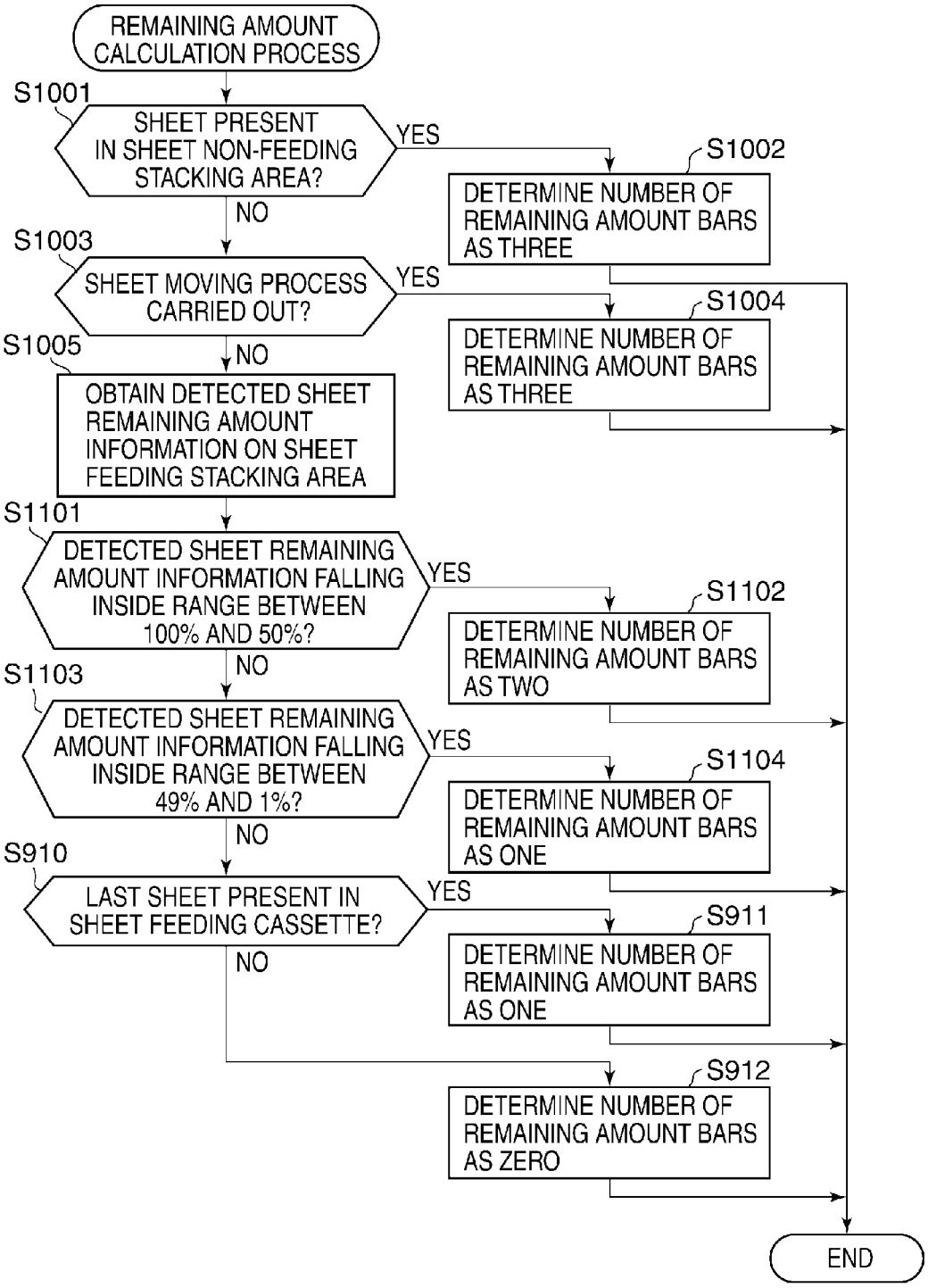
FIG. 11 is a flowchart showing the procedure of a variation of the remaining amount calculating process in FIG. 10.

FIG. 11 is a flowchart showing the procedure of a variation of the remaining amount calculating process in FIG. 10.

The process in FIG. 11 is carried out by the CPU 107 executing a variety of programs stored in the ROM 108 and the HDD 110.

Referring to FIG. 11, first, the CPU 107 carries out the same process as that in the steps S1001 to S1005 in FIG. 10. The CPU 107 then determines whether or not detected sheet remaining amount information on the sheet feeding stacking area 308 falls inside a range between 100% and 50% (step S1101).

As a result of the determination in the step S1101, when the detected sheet remaining amount information falls inside the range between 100% and 50%, the CPU 107 determines the number of remaining amount bars corresponding to the remaining amount of sheets in the large-capacity sheet feeding cassette 206 as "two" (step S1102). Specifically, according to this variation, even when a sufficient amount of sheets are stacked in the sheet feeding stacking area 308, the number of remaining amount bars corresponding to the remaining amount of sheets in the large-capacity sheet feeding cassette 206 is indicated as "two" when no sheets are present in the sheet non-feeding stacking area 309 so as to provide notification that the remaining amount of sheets in the large-capacity sheet feeding cassette 206 is not enough. After that, the CPU 107 terminates the present process.

As a result of the determination in the step S1101, when the detected sheet remaining amount information does not fall inside the range between 100% and 50%, the CPU 107 determines whether or not the detected sheet remaining amount information falls inside a range between 49% and 1% (step S1103).

As a result of the determination in the step S1103, when the detected sheet remaining amount information falls inside the range between 49% and 1%, the CPU 107 determines the number of remaining amount bars corresponding to the remaining amount of sheets in the large-capacity sheet feeding cassette 206 as "one" (step S1104). When the detected sheet remaining amount information does not fall inside the range between 49% and 1%, the CPU 107 carries out the same process as that in the steps S910 to S912 in FIG. 9 and terminates the present process.

According to the variation described above, when no sheets are present in the sheet non-feeding stacking area 309, the number of remaining amount bars corresponding to the remaining amount of sheets in the large-capacity sheet feeding cassette 206 is determined as "two" or less based on detected sheet remaining amount information on the sheet feeding stacking area 308. As a result, as compared to the way of displaying a remaining amount of sheets in the embodiment described above, notification that the remaining amount of sheets in the large-capacity sheet feeding cassette 206 is not enough is provided quickly, and hence cases where the large-capacity sheet feeding cassette 206 runs short of sheets are reduced.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-077973, filed Apr. 6, 2015 which is hereby incorporated by reference herein in its entirety.

What is claimed is:

1. An image forming apparatus with a sheet feeding unit that has a first stacking unit and a second stacking unit, comprising:

a moving unit configured to, when sheets stacked in the first stacking unit have run out, move sheets stacked in the second stacking unit to the first stacking unit;

a remaining amount detector configured to detect a remaining amount of sheets in the sheet feeding unit; and a display unit configured to provide an indication corresponding to any level among a plurality of levels which represents the remaining amount of sheets in the sheet feeding unit based on a detection result by said remaining amount detector, wherein in a case where sheets are stacked in both of the first stacking unit and the second stacking unit, said display unit provides an indication corresponding to a level representing a largest remaining amount of sheets among the plurality of levels regardless of a remaining amount of sheets in the first stacking unit.

2. The image forming apparatus according to claim 1, wherein even while said moving unit is moving sheets, said display unit provides the indication a corresponding to the level representing the largest remaining amount of sheets among the plurality of levels.

3. The image forming apparatus according to claim 1, wherein even when no sheets are stacked in the second stacking unit, and the remaining amount of sheets in the first stacking unit is the largest, said display unit provides the indication corresponding to the level representing the largest remaining amount of sheets among the plurality of levels.

4. The image forming apparatus according to claim 1, wherein when no sheets are stacked in the second stacking unit, and the remaining amount of sheets in the first stacking unit is the largest, said display unit provides an indication corresponding to a level other than the level representing the largest remaining amount of sheets among the plurality of levels.

5. The image forming apparatus according to claim 1, further comprising a setting unit configured to set a mode that relates to display of a remaining amount of sheets, wherein when a first mode is set by said setting unit, said display unit provides indications varying with remaining amounts of sheets in the second stacking unit, and when a second mode is set by said setting unit, said display unit provides the indication corresponding to the level representing the largest remaining amount of sheets among the plurality of levels in response to sheets being stacked in the second stacking unit.

6. The image forming apparatus according to claim 5, wherein when the first mode is set, said display unit provides an indication based on a result obtained by totaling the remaining amount of sheets in the first stacking unit and a remaining amount of sheets in the second stacking unit.

7. A control method for an image forming apparatus with a sheet feeding unit that has a first stacking unit and a second stacking unit, comprising:

a moving step of, when sheets stacked in the first stacking unit have run out, moving sheets stacked in the second stacking unit to the first stacking unit;

a detecting step of detecting a remaining amount of sheets in the sheet feeding unit; and a display step of providing an indication of a corresponding to any level among a plurality of levels which represents the remaining amount of sheets in the sheet feeding unit based on a detection result in the detecting step, wherein in a case where sheets are stacked in both of the first stacking unit and the second stacking unit, the display step provides an indication corresponding to a level representing a largest remaining amount of sheets among the plurality of levels regardless of a remaining amount of sheets in the first stacking unit.

8. A non-transitory computer-readable storage medium storing a program for causing a computer to execute a control method for an image forming apparatus with a sheet feeding unit that has a first stacking unit and a second stacking unit, the control method for the image forming apparatus comprising:

a moving step of, when sheets stacked in the first stacking unit have run out, moving sheets stacked in the second stacking unit to the first stacking unit;

a detecting step of detecting a remaining amount of sheets in the sheet feeding unit; and a display step of providing an indication of a corresponding to any level among a plurality of levels which represents the remaining amount of sheets in the sheet feeding unit based on a detection result in the detecting step, wherein in a case where sheets are stacked in both of the first stacking unit and the second stacking unit, the display step provides an indication corresponding to a level representing a largest remaining amount of sheets among the plurality of levels regardless of a remaining amount of sheets in the first stacking unit.

9. The image forming apparatus according to claim 4, wherein said remaining amount detector has a first sensor that detects a remaining amount of sheets in the first stacking unit, and wherein said display unit provides an indication corresponding to a level according to a detection result by the first sensor.

10. The image forming apparatus according to claim 1, wherein said remaining amount detector has a first sheet presence/absence sensor that detects presence or absence of sheets in the first stacking unit and a second sheet presence/absence sensor that detects presence or absence of sheets in the second stacking unit.

11. The image forming apparatus according to claim 1, wherein the sheet feeding unit is a single sheet feeding cassette having the first stacking unit and the second stacking unit.

* * * * *